US008951172B2

(12) United States Patent
Marcus

(10) Patent No.: US 8,951,172 B2
(45) Date of Patent: Feb. 10, 2015

(54) RECONFIGURABLE WEIGHTED CLUB TRAINING DEVICE WITH INTERNAL CAVITY

(71) Applicant: Onnit Labs, LLC, Austin, TX (US)

(72) Inventor: Aubrey Marcus, Austin, TX (US)

(73) Assignee: Onnit Labs, LLC, Austin, TX (US)

( * ) Notice: Subject to any disclaimer, the term of this patent is extended or adjusted under 35 U.S.C. 154(b) by 147 days.

(21) Appl. No.: 13/828,134

(22) Filed: Mar. 14, 2013

(65) Prior Publication Data

US 2014/0213422 A1 Jul. 31, 2014

Related U.S. Application Data

(60) Provisional application No. 61/759,056, filed on Jan. 31, 2013.

(51) Int. Cl.
*A63B 21/00* (2006.01)
*A63B 21/075* (2006.01)

(52) U.S. Cl.
CPC ..... *A63B 21/075* (2013.01)
USPC ..... 482/109; 482/110; 482/106

(58) Field of Classification Search
USPC ..... 482/104, 105, 106, 109, 110
See application file for complete search history.

(56) References Cited

U.S. PATENT DOCUMENTS

| | | | | |
|---|---|---|---|---|
| 295,429 | A * | 3/1884 | Reach | 482/109 |
| 5,312,308 | A * | 5/1994 | Hamilton et al. | 482/44 |
| 2008/0202317 | A1 * | 8/2008 | Capotosto | 84/422.4 |

* cited by examiner

*Primary Examiner* — Jerome w Donnelly
(74) *Attorney, Agent, or Firm* — The Culbertson Group, P.C.; Nathan H. Calvert

(57) ABSTRACT

An adjustable-weight club exercise device is provided having improved safety, adjustability, and manufacturability. The club body includes multiple recesses designed to receive removable weights. The recesses are all accessible individually to insert or remove weights in a motion perpendicular to the longitudinal direction. The recesses are formed by ridges designed to secure the weights to prevent any movement in the longitudinal direction. The device may be operated with any or none of the recesses filled. A door and latch design are provided to allow access to the recesses and securely close the club body.

20 Claims, 6 Drawing Sheets

RECONFIGURABLE WEIGHTED CLUB TRAINING DEVICE WITH INTERNAL CAVITY

CROSS-REFERENCE TO RELATED APPLICATION

The Applicants claim the benefit, under 35 U.S.C. §119(e), of U.S. Provisional Patent Application No. 61/759,056 filed Jan. 31, 2013, and entitled "Reconfigurable Weighted Club Training Device With Internal Cavity." The entire content of this provisional application is incorporated herein by this reference.

TECHNICAL FIELD OF THE INVENTION

This invention relates to physical training or workout devices known as Indian clubs or leverage clubs, and particularly to an Indian club device with a reconfigurable weight and repositionable center of mass.

BACKGROUND OF THE INVENTION

In recent years, the general public has become more aware of athletic training techniques and devices, such as the kettle bell. The use of kettle bells and training allow more explosive and natural acceleration and deceleration movements than traditional dumbbells. Also known is a weighted club device referred to variously as an Indian club, exercise club, Clubbell®, and weight club, which offer similar improvements in the quality of training over dumbbells and kettle bells. An Indian club is generally a club-shaped weight designed to be swung in circular motions in a manner designed to improve grip strength and generally challenge muscle tissue in a variety of dimensions in a manner safer and more productive than ordinary dumbbells or kettle bells.

Indian club's are traditionally provided having a fixed weight, and the athlete wishing to train with Indian club's of different weights must have a set of multiple Indian club's with different weights. Previous schemes to provide adjustable-weight exercise devices generally suffer from safety and usability issues.

SUMMARY OF THE INVENTION

An adjustable-weight club exercise device is provided having improved safety, adjustability, and manufacturability. The club body includes multiple recesses designed to receive removable weights. The recesses are all accessible individually to insert or remove weights in a motion perpendicular to the longitudinal direction. The recesses are formed by ridges designed to secure the weights to prevent any movement in the longitudinal direction. The device may be operated with any or none of the recesses filled. A door and latch design are provided to allow access to the recesses and securely close the club body.

These and other advantages and features of the invention will be apparent from the following description of the preferred embodiments, considered along with the accompanying drawings.

DESCRIPTION OF PREFERRED EMBODIMENTS

Figure 1:
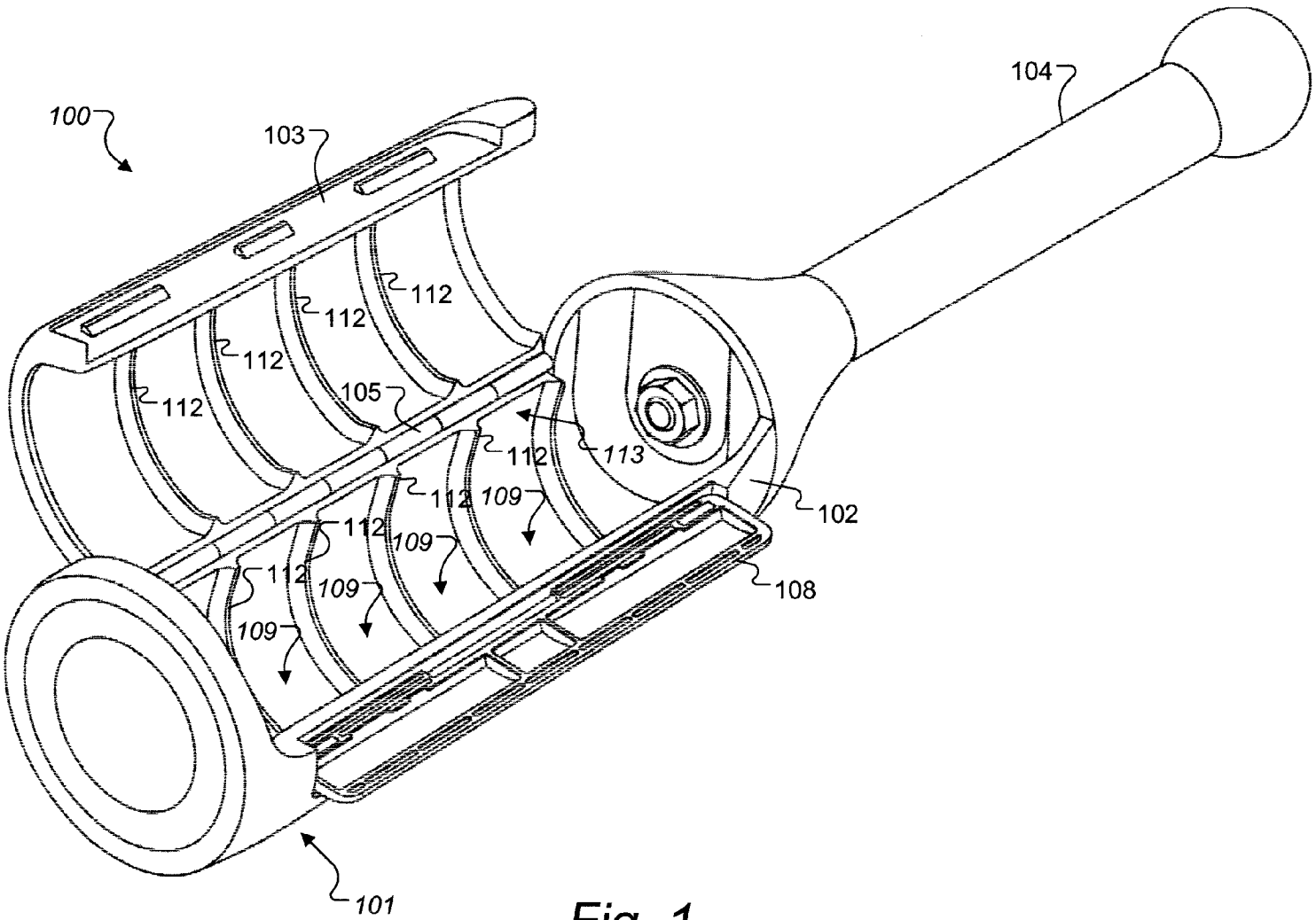
FIG. 1 is a perspective view of an adjustable-weight exercise device according to one embodiment of the present invention.

FIG. 1 shows an adjustable-weight exercise device 100 in the shape of the club, generally referred to herein as an Indian club. The device 100 includes an elongated body 101, which is connected rigidly to an elongated handle 104. The body 101 is configured with an interior cavity defining several recesses 109 each designed to securely hold a removable weight. In this embodiment, the body is constructed of a tray member 102 and a door 103 attached to the tray member 102 with a hinge 105. When the door 103 is closed and secured with the over center latch 108, the cavity is secured closed and the Indian club is configured to be swung and spun about by an athlete in training.

Figure 2:
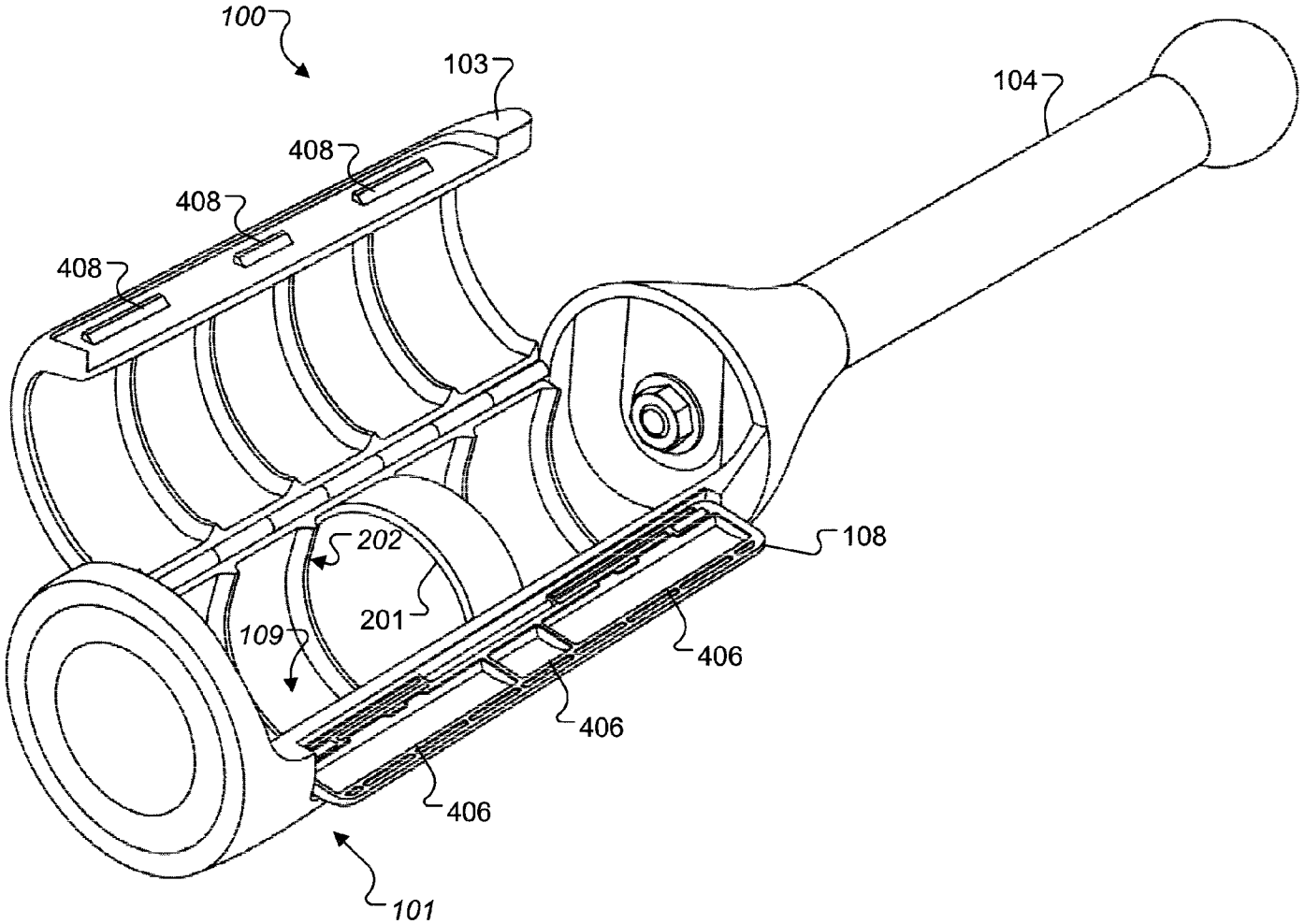
FIG. 2 is a perspective view of the same device with a weight inserted into one of the device's recesses.

As may be seen in FIG. 2, when the door 103 is opened, in this preferred version by opening the over-center latch 108 as described below, the recesses 109 may be emptied of weights or filled with as many weights as desired, preferably one weight per cavity as depicted by the weight 201 in FIG. 2. Each recess 109 is preferably defined by a raised ridge 112 formed in the perpendicular direction to the longitudinal axis of the device 100, having edges shaped to hold the weights 201 with an interference fit when door 103 is closed. Preferably door 103 also has ridges 112 (FIG. 1) which match up to those in the tray member 102.

In a preferred version, as discussed further below, the device 100 is made from steel coated with reaction injection molding (RIM) plastic, which not only protects the steel but creates a softer surface with a high coefficient of friction that can more reliably hold the weights 201 without shifting. Preferably, the outer surface of the removable weights 201 has a high coefficient of friction in order to limit the removable weight slipping out of the recesses in the event that the door is not properly closed. A coating on the weights 201 also allows a tight or "interference fit" between the weight and the recess 109 walls and ridges 112, which helps keep the weights immobile whether the door 103 is open or closed. The weight is also preferably shaped not as a perfect round disc but as an oblong disc or plate with rounded ends that fit the shape of the recess exactly, and flat walls that fit to the flat walls 113 of each recess 109 when the door 103 is closed. This provides a tight fit for the weights and helps prevent any possible dangerous detachment of the weights should the device be used with the door 103 not properly secured. Further, it is noted that the closed-off distal (club) end of the device also helps prevent safety problems because the main forces on the weights when the device is being swung are centrifugal forces in the distal direction. No door or removable cap is provided at the distal end, preventing the removable weights from flying out when the device is being swung at high speed. Finally, the design and surface material of the ridges 112 defining each removable weight recess 109 help ensure no removable weight flies out of the club device if the door is not properly closed. In particular, a force on a removable weight in the distal direction pushes the weight against the distal side ridge 112 of its containing recess. The flat wall portion of the ridge (113 in FIGS. 1 and 4A) provides opposing flat walls on the recess even if the door 103 is open. Any distal force on a weight pushes the weight harder into the ridge 112 and increases the interference fit forces between the weight and the ridges. As the weight is pushed into the ridges of the opposing flat walls, it is held more securely by forces in the distal direction which push it more securely against the ridges and create a squeezing, oppositional pair of forces between the flat walls 113.

Figure 3:
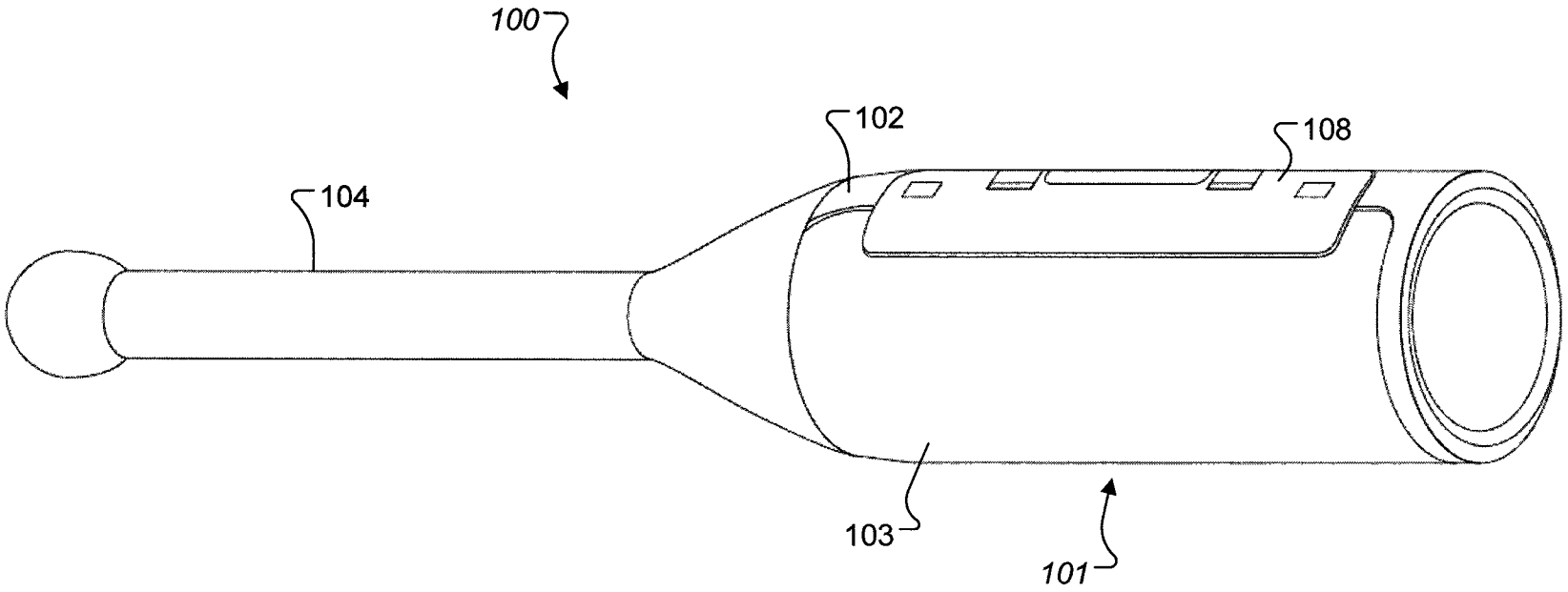
FIG. 3 is a perspective view of the same device with the door and over-center latch closed to configure the device for exercise activity.

Such a position is shown in FIG. 3, where the device is shown with the door 103 in a closed position, with the outer curved surface of door 103 matching with the tray member 102 such that body has an exterior cylinder-like shape. The latch 108 also preferably has a curved outer surface designed to present a largely uninterrupted and flush cylindrical shape around the device, allowing, of course, for joints and recesses by which the latch may be operated. While the cylindrical shape is preferred, other embodiments may have other suitable shapes such as an oval cross-section, or a rectangular or rounded rectangle cross-section, for example. Further, while the preferred device depicted here has a largely constant circumference in the weight-carrying portion of the body containing recesses 109, other versions may, of course, have varying circumferences along the length of device 100, allowing for different traditional club-like shapes to be matched, or newly created club shapes to be accommodated.

As can be further seen in the Figures, the cavity is formed by interior surfaces of the tray member 102 and door 103, the interior surfaces including a lower curved surface on the tray member 102 and an upper curved surface on the door 103, and flat back and front walls 113 (better seen in the cross section of FIG. 4A) joining the lower and upper curved surfaces. Referring to the placement and design of the weight 201 in FIG. 2, the weights are formed as a plate having first and second curved edges adapted to match to the lower and upper curved surfaces, the plate having third and fourth flat edges adapted to fit the flat back and front walls 113 of the cavity. The ridges or retaining structures 112 formed along the inner surface of the tray member 102 and door 103 are preferably shaped to match the edges of weights 201. In the preferred version, the shape of the ridges is that of a steep triangle with a flattened top, as can be seen from the cross section of the ridges shown at edges of tray member 102 in FIG. 1. The weight has a beveled edge contoured to match the ridges 112 triangular shape to allow easy settling of the weight into the cavity and stabilize each weight 201 in the inserted position within each recess 109. It is noted that, in this embodiment, ridges 112 are formed both along the upper and lower curved surfaces, and the back and front walls 113 of the cavity. Other embodiments may place the ridges or defining walls of the recesses 109 only on the flat walls, or only on the curved surfaces. Further, some embodiments may place ridges or defining walls only on the tray member 102, or another suitable structure provided for the body 101, and not on the door or other closing structure.

While this embodiment defines the recesses 109 with ridges 112, other embodiments may use other suitable methods. For example, one alternative might provide walls that span more of the cylindrical cavity than ridges 112 span, or other embodiments may provide for a device with a more solid club head or body 101, in which individual voids are formed as slots to receive individual weights. Further, some embodiments may define each recess with an individual door or compartment in the body 101.

In use of the device, it may be understood that the one or more of the removable weights 201 may be repositioned in the recesses 109 to change a center of gravity of device 100 in the longitudinal direction. The shape and surface of both the ridges 112 and weights 201 prevents movement in the longitudinal direction during use, even when the adjacent recess to a filled recess is empty. Such repositioning allows a user not only to reconfigure the weight of the device as described below, but also for configurations that have at least one empty recess 109, to adjust the center of gravity of the device in the longitudinal direction. This directly affects and allows adjustment of the torque applied to the athlete who is holding and swinging the device for any particular swing radius and speed, with the torque being considered at the grip of the device. Further, if each recess 109 is filled with a weight, device 100 has a determined weight and center of gravity that may be adjusted by selecting which weight 201 to remove. In this embodiment there are five weights 201, each weighing five pounds, which allows the device 100 weight to be adjusted within a 30-pound range by filling the body 101 with zero, one, two, three, four, or five weights. Other embodiments may, of course, have other values for weights 201. In particular, a version with smaller weight values is considered for beginning users who desire a club having a base, unloaded weight of approximately 10 or 15 pounds, which might be provided, for example, with five one pound weights or five two-pound weights adapted to fit into suitable recesses such as those described herein for the larger weights. It is preferable, but not required, that there are at least five recesses and removable weights; device 100 is adapted to be used with any number, including zero, of the recesses filled with removable weights no matter what the size or weight value of the device. Other embodiments may include a smaller device with any lower number of recesses, for example three, which might be used with two pound weights to increase a three-pound base weight club to five pounds, seven pounds, and nine pounds. One pound weights may be used to increase a two-pound base weight club to three, four, or five pounds in a similar configuration.

Further, in use of the device, the device presents access to the cavity and the multiple recesses 109 though a door 103 opening along the longitudinal direction of the device 100, rather than at the end as other non-preferred versions might provide. This allows the user to select which recess to place a weight in, rather than feeding weights in through the end of the device. All recesses 109 are accessible directly through the door 103 to add or remove a weight 201 (FIG. 2) in one step, even when every other recess is filled with a weight. The device 100 may be used with any selected combination of one or more recesses 109 empty, and any selected combination of recesses 109 filled with weights.

FIGS. 4A-D show a cross section of the same device 100 in a sequence depicting the operation of over-center latch 108, which is configured to secure the door 103 closed against the tray member 102. Other versions may, of course, use other suitable latches to allow access to the device 100 interior.

Figure 4B:
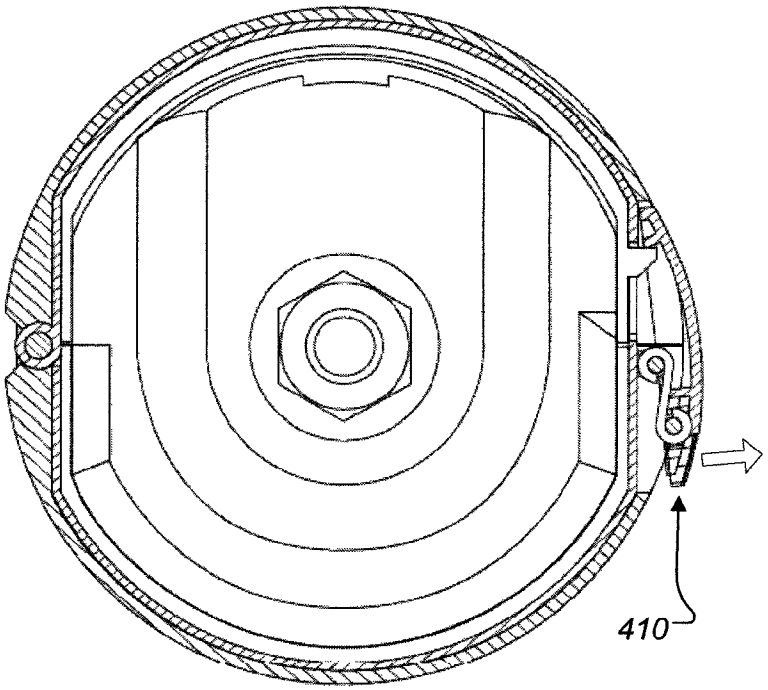
FIGS. 4A-D are a series of cross-section views showing the operation of the over-center latch to close and secure the device in this embodiment.
Figure 4A:
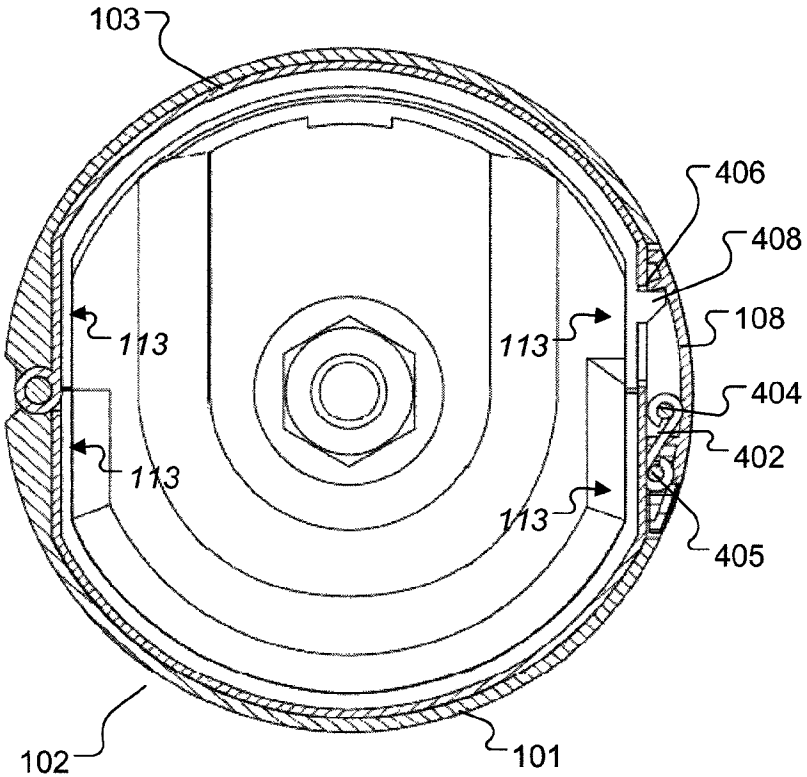

Referring to FIG. 4A, the cross section is of the body 101 facing toward the handle 104. The door 103 is in the closed position in which the latch 108 creates a flush surface with outer surface of body 101, by presenting the curved edge of latch 108 outward and the flat inner edge of latch 108 pressed against the outer surface of flat side walls 113 of the tray member 102 and door 103. In this position, latch 108 is held closed by pressure of hook members 406 onto receiving members 408 on the outer surface of door 103's flat side wall 113. As can be seen in the perspective view of FIG. 2, both the receiving members 408 and hook members 406 are preferably wide formations extending longitudinally along the respective surfaces of door 103 and latch 108. In the case of the hook members 406, these are preferably each formed as a tongued edge of an indentation formed along the inner surface of latch 108, as can be seen in FIG. 2. Tongue members 408 are preferably formed of plastic, and in this preferred version, are connected through slots in the door 103 to the inner plastic sheath of door 103. Tongue members 408 may also be formed of the same metal as that underlying the door 103.

Referring again to FIG. 4A, the construction of the over-center latch 108 can be seen as having over-center linkages 402 which are pivotally connected to the tray member 102 by hinge pins 404 and also pivotally connected to the latch 108 by hinge pins 405. In the preferred version, there are two linkages 402 so connected and aligned longitudinally along latch 108 as can be seen in FIG. 2 so as to provide stability and strength for latch 108.

Figure 4D:
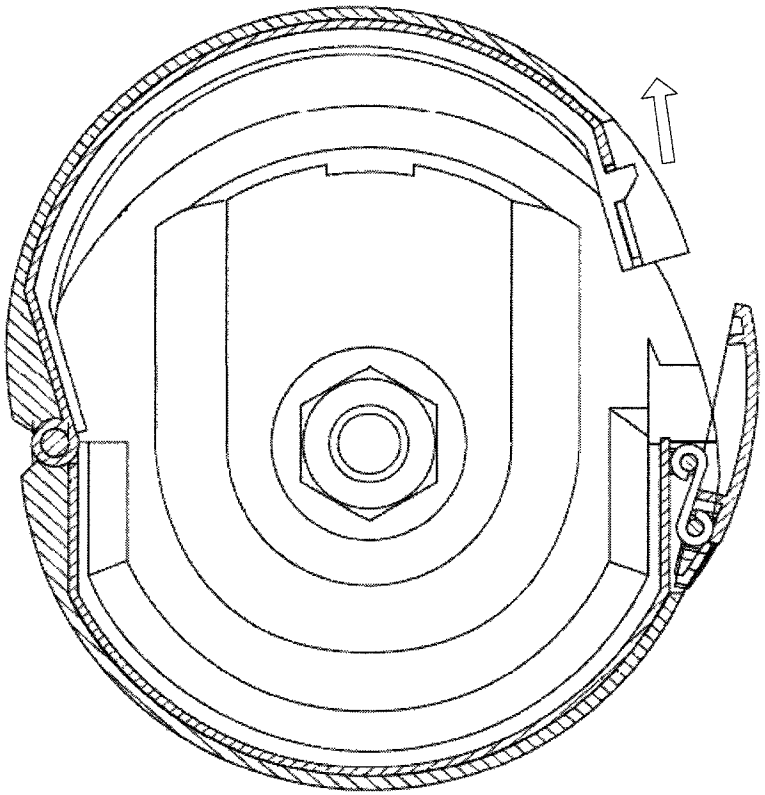
Figure 4C:
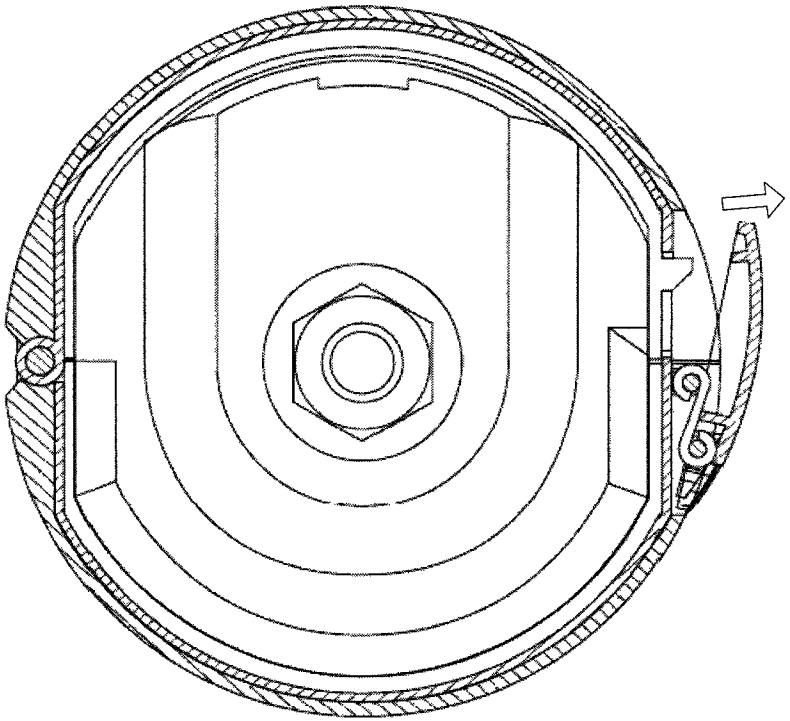

Now, the operation of latch 108 may be understood with further reference to FIGS. 4B through 4D, which show a sequence of latch 108 and door 103 opening. Latch 108 is opened in a sequence of two movements, the first depicted in FIG. 4B which involves pulling the lower edge 410 of latch 108 away from body 101 in the direction indicated by the arrow. This provides enough freedom of fit for the second movement, which is for hook members 406 to be pulled away from receiving members 408, as depicted by the arrow in FIG. 4C. This frees door 103, which was previously held in place by pressure against receiving members 408, to be pulled open in the direction of the arrow in FIG. 4D.

Figure 5:
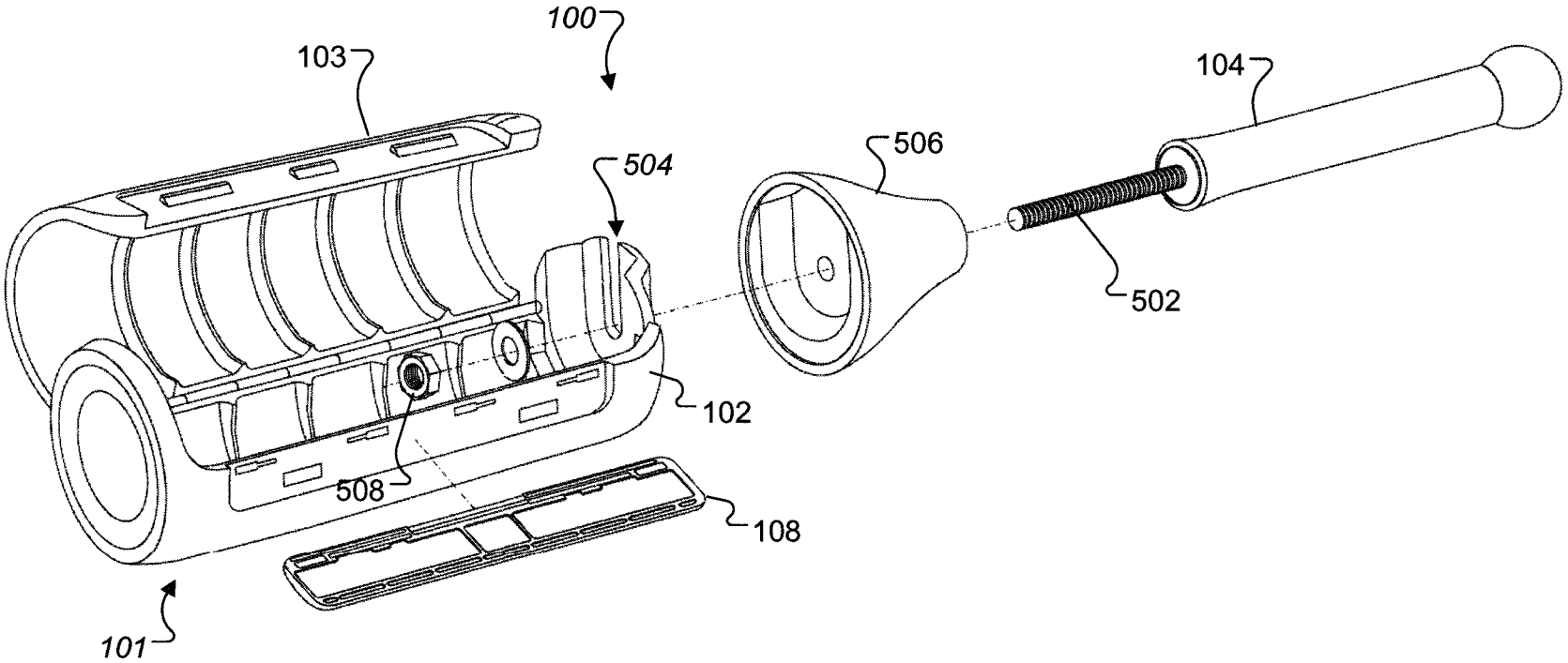
FIG. 5 is an exploded view showing the construction of a device according to a preferred embodiment.

Referring to the exploded view of the preferred device in FIG. 5, the various parts of device 100 and construction thereof are further described. The device 100 is preferably constructed with a mixed material scheme in which the tray member 102 and door 103 are formed of metal coated with reaction injection molding (RIM) plastic. In the cross section of FIG. 4A, the RIM plastic is shown as the outer materials and the metal as the center hatched material. Other versions may, of course, use other suitable materials such as molded plastic, wood, milled metal-like aluminum, or composite metal for tray member 102 and door 103.

Referring to the assembly of device 100, handle 104 includes a central rod 502 partially enclosed in plastic which forms the grip portion of handle and the end knob or enlarged portion at the proximal end of the handle 104 opposite the protruding central rod 502. The strength and rigidity of handle 104 is provided by the central rod 502, but the additional radius required to provide a comfortable gripping surface and the knob-like shape at the end are preferably provided with plastic to reduce the mass of device at the handle end. Such weight distribution allows the torque provided by moving the weight toward the distal, club head, end of the device. The rod 502 is adapted to extend through an opening 504 in an end wall of the body 101 when the handle 104 is connected to the body 101, in this version to the tray member 102 that forms the main part of the body. In the preferred assembly, a collar member 506 is disposed between handle 104 and body 101, with the central rod 502 extending through a central hole in collar member 506 to pass through the collar member 506 and opening 504 and be secured rigidly to body 101 with a bolt and nut 508.

The proximal end of handle 104 has a knob-like shape helping prevent the device from slipping from a user's grip if the friction of the user's grip with the handle is lost through inadequate grip strength or excessive slickness. The relative size of the end knob versus the cylindrical gripping area of the handle should be kept just large enough to assist the grip as discussed above, without being so large as to effect the user's ability to align the device along their forearm during use, because an overlarge knob would cause lateral deviation of the proximal end of handle 104 such that the user's forearm muscles could not stabilize the device as an extension of the arm during swinging movements.

It is noted that tray member 102 is preferably constructed by welding three pieces of metal together, the three pieces being the curved half-cylinder portion with flat walls, the round distal end piece that forms the permanent cap or end of the club in the preferred device, and the shaped proximal end piece that fits into collar 506 for attachment to handle 104. Other versions may of course be constructed differently. For example, a club head employing molded plastic for the body structure might form the tray member of a single piece.

Collar 506 is constructed preferably of plastic and serves to provide a smoothly contoured outer surface at the joint of handle 104 to body 101. Some versions may not have a collar and may directly connect the handle and body. Other versions, particularly versions formed of plastic, may have handle and body constructed largely as a single piece. The preferred collar shown has an indentation matching the proximal end of tray member 102, providing a stable fit that prevents rotation around the longitudinal axis by the asymmetrical shape about the longitudinal axis.

As used herein, the terms "comprising," "including," "carrying," "having," "containing," "involving," and the like are to be understood to be open-ended, that is, to mean including but not limited to.

Any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. An adjustable-weight exercise device in the shape of a club, the device comprising:

(a) an elongated body comprising a tray member and a door attached to the tray member with a hinge;

(b) an elongated handle rigidly connected to the body in the longitudinal direction such that the handle and body together have a club-like shape;

(c) a cavity formed within the body, the cavity including multiple recesses defined by ridges formed along an inner surface of the cavity perpendicular to the longitudinal direction;

(d) multiple removable weights each having an outer surface with at least one side adapted to fit into one of the multiple recesses; and (e) wherein the door is movable to a first open position allowing access to the cavity to remove or insert the removable weights to adjust the total weight of the exercise device, the door further movable to a second closed position securing the removable weights in the cavity.

2. The adjustable-weight exercise device of claim 1, further comprising an over-center latch configured to secure the door closed against the tray member.

3. The adjustable-weight exercise device of claim 1, in which the door is configured, when in the second closed position, to match with the tray member such that body has an exterior cylinder-like shape.

4. The adjustable-weight exercise device of claim 2, further comprising an over-center latch configured to secure the door closed against the tray member, the over-center latch having a curved outer surface adapted such that when the latch is closed the outer surface is flush with the exterior cylinder-like shape of the body.

5. The adjustable-weight exercise device of claim 1, in which:

(a) the cavity is formed by interior surfaces of the tray member and door, the interior surfaces including a lower curved surface and an upper curved surface, and flat back and front walls joining the lower and upper curved surfaces, and (b) the weights are formed as a plate having first and second curved edges adapted to match to the lower and upper curved surfaces, the plate having third and fourth flat edges adapted to fit the flat back and front walls.

6. The adjustable-weight exercise device of claim 5, in which the lower curved surface is formed on the tray member, and the upper curved surface is formed on the door.

7. The adjustable-weight exercise device of claim 5, in which the ridges formed along the inner surface of the cavity are formed on the lower curved surface and the upper curved surface.

8. The adjustable-weight exercise device of claim 1, in which one or more of the removable weights may be repositioned in the recesses to change a center of gravity of the exercise device in the longitudinal direction.

9. The adjustable-weight exercise device of claim 1, in which the tray member and door are formed of metal coated with reaction injection molding (RIM) plastic.

10. The adjustable-weight exercise device of claim 1, in which the handle comprises a central rod partially enclosed in plastic, the central rod adapted to extend through an opening in an end wall of the body when the handle is connected to the body.

11. The adjustable-weight exercise device of claim 1, in which the outer surface of the removable weights has a high coefficient of friction in order to limit the removable weights slipping out of the recesses.

12. The adjustable-weight exercise device of claim 1, in which there are at least five recesses and removable weights, the device adapted to be used with any number, including zero, of the recesses filled with removable weights.

13. An adjustable-weight exercise device comprising:

(a) an elongated body having a proximal end and a distal end;

(b) an elongated handle rigidly connected to the body at the proximal end and aligned with the body in the longitudinal direction;

(c) a cavity formed within the body, the cavity including at least three recesses, each recess having a shape formed to hold a removable weight;

(d) one or more removable weights having an outer surface at least at one side adapted to fit the edges of the cavity; and (e) the body having a door configured to be in a first opened position and a second secured closed position, the door providing individual access to all of the recesses such that a user may remove or add one of the one or more removable weights from any single selected one of the recesses.

14. The adjustable-weight exercise device of claim 13, in which the recesses are defined by ridges formed along an inner surface of the cavity perpendicular to the longitudinal direction and in which removable weights may only be inserted into the recesses by perpendicular movement to the longitudinal direction.

15. The adjustable-weight exercise device of claim 14 in which the ridges have a triangular shape with two opposing sloped edges.

16. The adjustable-weight exercise device of claim 13, in which:

(a) the body further comprises a tray member connected to the door and the handle, and the cavity is formed by interior surfaces of the tray member and the door, the interior surfaces including a lower curved surface and an upper curved surface, and flat back and front walls joining the lower and upper curved surfaces; and (b) the weights are formed as a plate having first and second curved edges adapted to match to the lower and upper curved surfaces, the plate having third and fourth flat edges adapted to fit the flat back and front walls.

17. The adjustable-weight exercise device of claim 16, in which the ridges formed along the inner surface of the cavity are formed on the lower curved surface and the upper curved surface.

18. The adjustable-weight exercise device of claim 16, further comprising an over-center latch configured to secure the door closed against the tray member, the over-center latch having a curved outer surface adapted such that when the latch is closed the outer surface is flush with the exterior cylinder-like shape of the body.

19. The adjustable-weight exercise device of claim 16, in which the ridges are designed to secure the removable weights to prevent any movement in the longitudinal direction relative to the body when a weight is inserted.

20. The adjustable-weight exercise device of claim 13, in which one or more of the removable weights may be repositioned in the recesses to change a center of gravity of the exercise device in the longitudinal direction.

* * * * *